United States Patent [19]

Shibue et al.

[11] 4,267,266

[45] May 12, 1981

[54] PHOTOGRAPHIC FILMS

[75] Inventors: Toshiaki Shibue; Koichi Nagayasu, both of Hino, Japan

[73] Assignee: Konishiroku Photo Industry Co., Ltd., Tokyo, Japan

[21] Appl. No.: 62,804

[22] Filed: Aug. 1, 1979

[30] Foreign Application Priority Data

Aug. 7, 1978 [JP] Japan ..... 53-96001

[51] Int. Cl.[3] ..... G03C 1/80; G03C 1/82

[52] U.S. Cl. ..... 430/530; 430/523; 430/527; 430/531; 430/961

[58] Field of Search ..... 96/67, 87 A, 114.4, 96/50 PL; 430/523, 527, 530, 531, 961

[56] References Cited

U.S. PATENT DOCUMENTS

| | | | |
|---|---|---|---|
| 2,059,829 | 11/1936 | Ward | 96/87 A |
| 2,090,016 | 8/1937 | Young et al. | 96/50 PL |
| 3,042,522 | 7/1962 | Ben-Ezra | 96/114.4 |
| 3,082,087 | 3/1963 | Guestaux et al. | 96/87 A |
| 3,364,044 | 1/1968 | Grabhöfer et al. | 96/114.4 |
| 3,532,501 | 10/1970 | Mackey et al. | 96/87 A |
| 3,630,742 | 12/1971 | Crawford | 96/114.4 |
| 4,050,934 | 9/1977 | Turner | 96/1 R |
| 4,069,053 | 1/1978 | Mayama et al. | 96/87 A |

FOREIGN PATENT DOCUMENTS

| | | | |
|---|---|---|---|
| 1430997 | 4/1976 | United Kingdom | 96/67 |
| 1466304 | 3/1977 | United Kingdom | 96/67 |

OTHER PUBLICATIONS

Abstract of German Patent DT No. 2849962 published May 23, 1979, Derwent Publications Ltd.

*Primary Examiner*—Won H. Louie, Jr.

*Attorney, Agent, or Firm*—Frishauf, Holtz, Goodman & Woodward

[57] ABSTRACT

A photographic film having at least one light-sensitive silver halide emulsion layer on one side of a support and at least one reverse side layer on the other side thereof which comprises, in said reverse side layer, a compound represented by formula [I]:

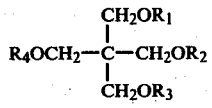

[I]

wherein $R_1$, $R_2$, $R_3$ and $R_4$ each represent a hydrogen atom or an aliphatic acyl group having from 12 to 24 carbon atoms provided that at least three of $R_1$, $R_2$, $R_3$ and $R_4$ each represent an aliphatic acyl group having from 12 to 24 carbon atoms, and a tertiary amine.

16 Claims, No Drawings

PHOTOGRAPHIC FILMS

This invention relates to photographic materials. More particularly, it relates to photographic films having an excellent reverse side layer with which the scratch-proof property of the film and the adhesion of the film to an adhesive tape have been improved, and on which unevenness by streak lines does not occur.

A scratch mark may sometimes be generated on the surface of a photographic film, during exposing or treating of the film such as processing and printing, by the contact or friction of the film with apparatuses. The scratch mark tends to be generated on the reverse side of a film which may readily come into contact with apparatuses and become severe cause of practical troubles upon printing and projection.

Scratch mark of the reverse side layer may be generated not only during treating steps but also during manufacturing steps of films. Currently, coating speed in the manufacturing steps has become remarkably higher as compared with that in conventional steps and the treating steps have been accelerated so that conditions under which scratch marks tend to be caused are increased.

Therefore, there have been required photographic films having reverse side layers which can resist such severe conditions.

Heretofore, various attempts have been made to improve the scratch-proof property of reverse side layer of photographic films.

The scratch-proof property has been improved, for example, by mixing a natural or synthetic wax with a binder in a dispersed or dissolved state and then coating the mixture on a support.

Concrete examples of such technique have been disclosed, for example, in U.S. Pat. Nos. 2,090,016; 3,042,522; 2,059,829; British Pat. No. 1,430,997; German Pat. No. 2,347,301.

In the prior art, however, there appear some drawbacks in that the scratch-proof property is not imparted in the latest rapid transfer process; the scratch-proof property is lost due to the dissolving out of the effective component in a film; it is difficult to adhere a film to a spool by using an adhesive tape when the film is set in a cartridge, even if the scratch-proof property is good; and a liquid remains on a film in an uneven state during the processing step.

A method in which an alkyl ester of pentaerythritol is incorporated, together with a cellulose derivative, in an intermediate layer and the second layer containing as a main component an antistatic agent is coated on said intermediate layer by using a solvent which does not dissolve said intermediate layer, is proposed, for example, in German Patent OLS No. 2849962.

According to the method, a lubricative surface is given and thereby the scratch-proof property is improved.

Further, the alkyl ester of pentaerythritol is not dissolved out even in the processing for development and the lubricative property is exhibited even after development process. To obtain such effect, it is necessary to locate a layer containing a compound which imparts lubricative property (hereinafter referred to as "lubricant"), i.e., an alkyl ester of pentaerythritol, under the second layer. In such constitution of a film, adhesion between a layer containing a lubricant and the second layer sometimes is insufficient, and there appears, due to the remarkable high-speed of the coating in the latest manufacturing step, in that the layers are liable to be separated during conveyance, rolling and so on and troubles tends to be caused in the transfer process.

As the antistatic agent to be incorporated in the second layer, there have been used various polyelectrolytes which give electroconductivity. However, many of these polyelectrolytes have defects in that they are liable to be influenced by water due to their hydrophilicity and thus undesirable phenomena such as whitening of an adhered surface, adhesion or transfer to other surface are liable to be caused.

In order to remove such defects, it has been attempted to use a polyelectrolyte which is obtained by copolymerizing such a hydrophobic monomer as vinyl chloride, vinylidene chloride, styrene, an alkyl acrylate, a fluorinated ester of acrylic acid and so on. Such a polyelectrolyte having a hydrophobic group, however, causes other troubles newly as compared with those which have no hydrophobic group, although it improves the undesirable properties such as adhesion or transfer to other surface.

For instance, when a photographic film is dried as such after the final water-washing step in the processing of the film, the film is dried in a state in which water drops adhere to the film and then a sort of unevenness, referred to as "unevenness by water drops" is caused. Upon printing such a photographic film having unevenness by water drops, the unevenness appears clearly on the printed image, and in the case of a reversal photographic film, the unevenness appears clearly on the image projected on a screen.

Therefore, various baths for preventing unevenness by water drops have hitherto been proposed as final processing baths for solving the problem of unevenness by water drops. As one example therefor, there is a solution for preventing unevenness by water drops (stabilizing solution) which contains an ethylene glycol derivative, sodium dodecylbenzenesulfonate, a carboxylic acid type amphoteric surfactant or a quaternary ammonium salts. All of these solutions are to solve the problem of unevenness by water drop by imparting wettability to the surface of a photographic film.

However, when such stabilizing solution is used, although the generation of unevenness by water drop on the surface of the side having a silver halide emulsion layer can be prevented since the layer is composed of such a hydrophilic binder as gelatin, etc., with respect to the side having a polyelectrolyte, it dissolves out partly or wholely during the steps of development process and the surface thereof becomes hydrophobic and thus other kind of stains is generated newly, particularly in the surface on which a polyelectrolyte having hydrophobic groups is adhered and which is difficult to be wetted. The stains become remarkable in cases where an alkyl ester of pentaerythritol is used in the first layer. Such stains are generated remarkably, particularly in an automatic developing machine (generally referred to as a hanger automatic developing machine) according to the so-called hanging method.

Such phenomenon occurs frequently in cases where the second layer incorporated with a polyelectrolyte in which is introduced hydrophobic groups is coated, and it occurs more strongly in cases where the first layer incorporated with a hydrophobic polymer and an alkyl ester of pentaerythritol is coated. The phenomenon may be considered to be caused because the surface becomes more difficult to be wetted after the development process due to the introduced hydrophobic groups or the lubricant incorporated. Namely, the surface becomes difficult to be wetted and thus the flow-down speed of a stabilizing solution becomes low. Upon rapid drying at high temperature, the stabilizing solution which is on the way of flowing down on the surface is dried as such to cause streak-like stains (hereinafter referred to "unevenness by streak lines").

Such unevenness by streak lines appears clearly on a printed or projected image in the same manner as in the case of unevenness by water drops.

An ordinary photographic film is fixed to a spool in a cartridge by using an adhesive tape. When a technique is directed to strengthen the hydrophobicity of the surface of a film, an adhesive tape does not adhere to the surface at all or, even if adhered, it is liable to be separated. Particularly, there is observed a drawback in that a film is separated from a spool at the time of photographing at high temperature.

It is therefore an object of the present invention to provide photographic films having an improved reverse side layer which may exhibit an excellent scratch-proof property and maintain sufficient lubricative property before and after processing, even if treatment with a bath containing a lubricant is not carried out at the time of processing.

It is another object of the invention to provide photographic films having a reverse side layer with which the film is adhered sufficiently by an adhesive tape to a spool or the like in a cartridge.

It is still another object of the invention to provide photographic films having a reverse side layer which shows good wettability so as to prevent the occurrence of unevenness by water drops, unevenness by streak lines or the like.

It is a further object of the invention to provide readily manufacturable photographic films having a reverse side layer in which the adhesion between the first and the second layers is so strong that no peeling-off phenomenon appears between the layers.

The inventors have found, after extensive investigations, that the objects of the present invention may be attained, by a photographic film which comprises at least one light-sensitive silver halide emulsion layer on one side of a support and at least one reverse side layer on the other side of the support, said reverse side layer comprising a compound represented by the following formula [I] and a tertiary amine

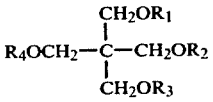

[I]

In the above formula [I], $R_1$, $R_2$, $R_3$ and $R_4$ each represent a hydrogen atom or an aliphatic acyl group having from 12 to 24 carbon atoms provided at least three of $R_1$, $R_2$, $R_3$ and $R_4$ each represent an aliphatic acyl group having from 12 to 24 carbon atoms. To explain more detailedly about the compound of formula [I], $R_1$, $R_2$, $R_3$ and $R_4$ each represent a hydrogen atom or an aliphatic acyl group having from 12 to 24 carbon atoms, preferably from 14 to 24 carbon atoms. The aliphatic acyl group according to the invention may be either a straight chain or branched one, preferably a straight chain.

As the aliphatic carboxylic acid for the aliphatic acyl group of the invention, a saturated carboxylic acid such as stearic acid as well as an unsaturated carboxylic acid such as parmitoleic acid may be employed.

As the tetraester of formula [I] according to the invention, there may be used an ester of one kind of carboxylic acid or an mixed ester of two through four kinds of carboxylic acids, and may further be used a mixture of a uniform and mixed esters.

As representative examples of the compounds of formula [I] to be used in the invention, there may be mentioned the following:

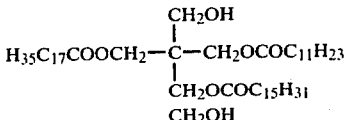

[I]-(1)

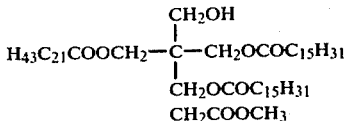

[I]-(2)

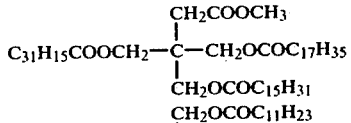

[I]-(3)

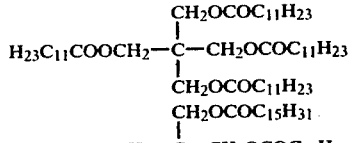

[I]-(4)

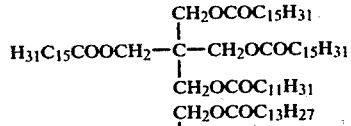

[I]-(5)

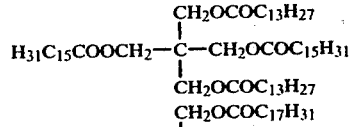

[I]-(6)

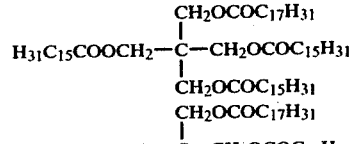

[I]-(7)

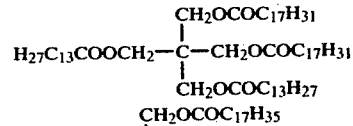

[I]-(8)

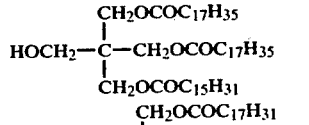

[I]-(9)

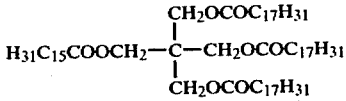

[I]-(10)

An amine which may be used in this invention is a tertiary amine which includes an aliphatic tertiary amine and the derivatives thereof. Particularly, a tertiary amine having from 8 to 24 carbon atoms may preferably be employed.

A primary or secondary amine is undesirable since they sometimes have bad influence on the photographic performances of a silver halide photographic emulsion.

As the tertiary amines to be used in this invention, the compounds of formula [II] described below may advantageously be employed.

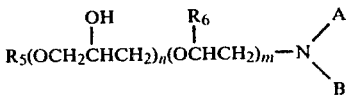

[II]

wherein $R_5$ represents an alkyl group having from 8 to 24 carbon atoms; $R_6$ represents a hydrogen atom, a methyl group or a group $—CH_2OR_7$ in which $R_7$ means a hydrogen atom, an alkyl group having from 1 to 7 carbon atoms, an aryl group or an aralkyl group; m and n each represent an integer of from 0 to 3 (provided $3 \geqq m+n \geqq 1$); A represents a group $$R_7\text{-}(OCH_2\overset{\overset{OH}{|}}{C}HCH_2)_p(OCH\overset{\overset{R_6}{|}}{C}H_2)_q$$

in which $R_6$ and $R_7$ have the same meanings as defined above, and p and q each represent an integer of from 1 to 3 (provided $3 \geqq p+q \geqq 1$); and B represents an alkyl group having from 1 to 7 carbon atoms, an aryl group, an aralkyl group or a group $$R_7(OCH_2\overset{\overset{OH}{|}}{C}HCH_2)_n(OCH\overset{\overset{R_6}{|}}{C}H_2)_m$$

in which $R_6$, $R_7$, m and n have the same meanings as defined above.

As representative examples of compounds of formula [II] which may preferably be used in the invention, there may be mentioned the following:

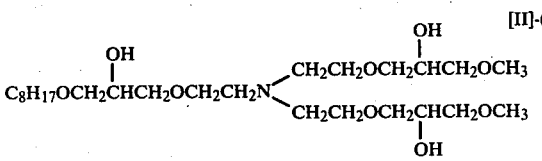
[II]-(1)

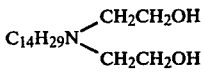
[II]-(2)

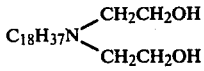
[II]-(3)

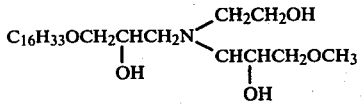
[II]-(4)

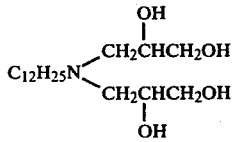
[II]-(5)

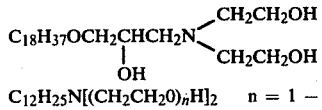
[II]-(6)

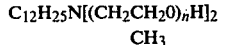
[II]-(7)

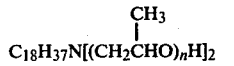
[II]-(8)

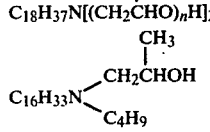
[II]-(9)

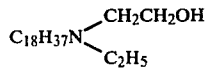
[II]-(10)

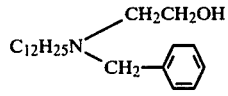
[II]-(11)

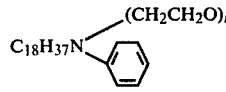
[II]-(12)

-continued

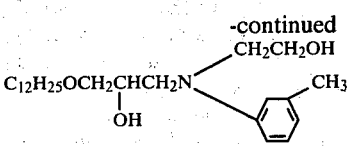
[II]-(13)

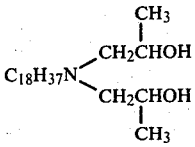
[II]-(14)

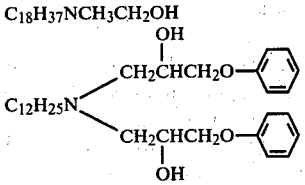
[II]-(15)

[II]-(16)

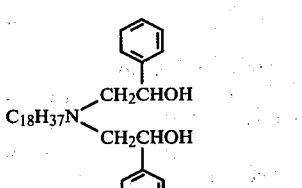
[II]-(17)

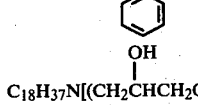
[II]-(18)

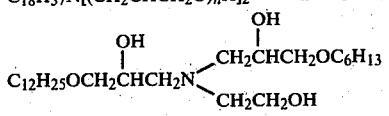
[II]-(19)

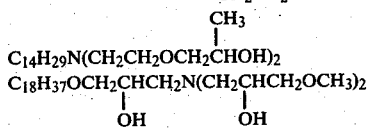
[II]-(20)

[II]-(21)

The tertiary amines to be used in this invention may be employed alone or in combination.

The reverse side layer of photographic films having the compound of formula [I] and a tertiary amine may be composed of one or more layers.

In cases where the reverse side layer is composed of more than one layer, the compounds of formula [I] and the tertiary amine may be incorporated in the same or different layers. An antistatic agent and a hydrophobic polymer may preferably be incorporated in the reverse side layer according to the invention.

It is desirable to incorporate a higher fatty acid in the reverse side layer in order to improve remarkably the adhesion between the layers. As the higher fatty acid which may preferably be used in this invention, there may be mentioned a fatty acid having from 8 to 24 preferably from 17 to 22 carbon atoms.

According to one preferred embodiment of the invention, a photographic film is provided which has a light-sensitive silver halide emulsion layer on one side of a support and at least one reverse side layer on the other side of the support, said reverse side layer comprising at least one layer [i] containing the compound represented by formula [I] and a hydrophobic polymer, and at least one layer [ii] containing an antistatic agent and a tertiary amine, preferably a tertiary amine represented by formula [II], said layer [i] being located closer to the support than said layer [ii].

According to another preferred embodiment of the invention, a photographic film is provided which comprises at least one layer [i] containing the compound of formula [I], a tertiary amine preferably of formula [II] and a hydrophobic polymer, and at least one layer [ii] containing an antistatic agent, said layer [i] being located closer to the support than said layer [ii].

According to still another preferred embodiment of the invention, a photographic film is provided which comprises at least one layer [i] containing the compound of formula [I], a higher fatty acid and a hydrophobic polymer and at least one layer [ii] containing an antistatic agent and a tertiary amine preferably of formula [II], said layer [i] being located closer to said support than said layer [ii].

According to further preferred embodiment of the invention, a photographic film is provided which comprises at least one layer [i] containing the compound of formula [I], a tertiary amine preferably of formula [II] and a hydrophobic polymer, and at least one layer [ii] having an antistatic agent, said layer [ii] being located closer to said support than said layer [i].

According to still further preferred embodiment of the present invention, the compound of formula [I], a tertiary amine preferably of formula [II], a hydrophobic polymer and an antistatic agent are incorporated in the same layer of the photographic film.

As the antistatic agent to be used in the invention, those which provide a good electroconductivity and show an excellent film-forming property when used in combination with a suitable binder may effectively be used.

As examples of such antistatic agents which may be employed in the invention, there may be mentioned, for example, a salt of a copolymer of styrene and styrene-nundecanoic acid as described in U.S. Pat. No. 3,033,679; a maleic acid resin or a maleinimide resin as described in U.S. Pat. No. 2,279,410; an alkali metal salt of an alkylarylpoly ether sulfonic acid, an alkali metal salt of a carboxylic acid polymer as described in U.S. Pat. No. 3,525,621; an alkali metal salt of a polycarboxylic acid as described in U.S. Pat. No. 3,630,742; a polystyrenesulfonic acid as described in U.S. Pat. No. 2,735,841; a quaternary salt of a polyvinylpyridine as described in U.S. Pat. No. 3,072,484; a quaternized polyethyleneimine as described in U.S. Pat. No. 3,479,215; a polyepichlorohydrine as described in U.S. Pat. No. 3,320,317; polyquaternized-alkyl-amino-acrylate as described in U.S. Pat. No. 2,882,157; and those as described in Japanese Patent Publications Nos. 46-24159/1971, 50-54672/1975, 50-94053/1975 and 52-129520/1977 as laid open to public inspection. Among these antistatic agents, those described in Japanese Patent Publications Nos. 46-24159/1971, 50-94053/1975, 50-54672/1975 and 52-129520/1979 as laid open to public inspection, may advantageously be employed.

In cases where the reverse side layer is composed of not less than 2 layers, said antistatic agent may be incorporated either in a layer which is located closer to the support or in a layer which is located further to the support. In cases when the reverse side layer is composed of not less than 2 layers, the layer which is located to the support will hereinafter be referred to as the first layer and the one further to the support will be referred to as the second layer.

In cases when a tertiary amine of the invention, particularly a tertiary amine of formula [II] is used in combination with a polyelectrolyte, the antistatic agent to be employed may preferably be a cationic one since an anionic antistatic agent may sometimes make the layer opaque. While the compound of formula [II] may be incorporated in one of the first and second reverse side layers, it may also be incorporated in not less than 2 layers at the same time.

When a polyelectrolyte is used as an antistatic agent in this invention, adhesion between the layers is improved.

For example, the adhesion between the first and second reverse side layers was investigated with respect to the samples of Examples mentioned below, in the second reverse side layer of which was incorporated a higher fatty acid.

The adhesiveness between layers was evaluated by means of the change of the specific surface resistance before and after a frictioning test. The specific surface resistance was measured at 25° C. under a relative humidity of 55%. As the results, Sample 2 showed specific surface resistances of $8.7\times10^8$ Ω/cm$^2$ before treatment and of $9.0\times10^8$ Ω/cm$^2$ after treatment (after ten time friction, hereinafter the same applies). Sample 3 showed specific surface resistances of $1.2\times10^9$ Ω/cm$^2$ before treatment and of $1.8\times10^9$ Ω/cm$^2$ after treatment. In contrast to those, Comparative sample 7 showed specific resistances of $8.6\times10^8$ Ω/cm$^2$ before treatment and of more than $10^{14}$ Ω/cm$^2$ after treatment.

It is also desirable to adopt a method in which, besides the above-mentioned polyelectrolyte, an inorganic oxide containing an electrolyte, particularly alumina sol, is coated as a reverse side layer.

Since many of antistatic agents belonging to a polyelectrolyte are hydrophilic in general, various unfavorable phenomena sometimes occur especially when they are applied for light-sensitive silver halide photographic materials. For instance, light-sensitive silver halide materials adhere to each other under high humidity, thus causing troubles in adhesion, or the antistatic layer sometimes dissolves out into a processing solution during processing and bound with other substances existing in the processing solution to cause turbid substances or sludge and the antistatic layer is lost by the processing for development. Such unfavorable phenomena can be removed by locating, as the first layer of the reverse side layer, a layer obtained by adhering alumina sol containing an electrolyte and by locating thereon, as the second layer, a layer containing a hydrophobic polymer.

It is extremely advantageous to incorporate the compound represented by formula [I] together with the above-mentioned hydrophobic polymer in the second reverse side layer in order to improve scratch-proof property during manufacturing or handling of photographic films. Although photographic films manufactured by the above method may greatly be improved in scratch-proof property, unevenness by streak lines is liable to be caused thereon in a stabilizing bath and adhesiveness of a tape thereto sometimes is insufficient in the wrapping step of manufacture.

According to the invention, unevenness by streak lines can be excluded and adhesiveness of a tape to films can be improved by incorporating a tertiary amine in the reverse side layer, more preferably by incorporating a tertiary amine, together with a hydrophobic polymer and the compound represented by general formula [I] in the second reverse side layer. In the second reverse side layer may optionally be incorporated further a matting agent and other various additives in accordance with the purpose for which the photographic film is used.

As the antistatic agent according to the invention, there may be used an inorganic oxide having a particle diameter of from 0.01 to 0.5μ besides the above-mentioned ones. In cases where the antistatic agent is silicon dioxide, aluminium oxide, magnesium oxide or other inorganic oxide having a particle diameter of 0.01 to 0.5μ, electrification of various materials used for manufacturing photographic films, photographic apparatuses and an automatic developing machine can remarkably be suppressed by adding these antistatic agents to the reverse side layer.

Therefore, there may be provided a photographic film which is excellent in scratch-proof property and with which unevenness by streak lines is prevented and adherence to a tape is good, by coating, directly on a support, a reverse side layer containing a hydrophobic polymer, the compound represented by general formula [I] and an inorganic oxide such as silicon dioxide mentioned above, without coating alumina sol or the like which contains an electrolyte mentioned above.

A hydrophobic polymer may be used in the invention if it is dissolved or dispersed in the coating solution and forms a film (thin layer) after the solution is coated and dried, and the thus formed layer is insoluble in an acidic or base aqueous solution.

As the hydrophobic polymer to be used in the invention are mentioned, for example, cellulose derivatives such as cellulose diacetate, cellulose triacetate, cellulose acetate butylate, cellulose nitrate, ethyl cellulose and the like; polyvinyl acetals; vinyl chloride/vinylidene chloride copolymer; vinyl chloride/acrylonitrile copolymer; acrylic acid ester/vinyl chloride/vinyl acetate copolymer; and so on.

Latices of these hydrophobic polymers may also be employed in the invention. As particularly preferred hydrophobic polymer may be mentioned cellulose derivatives and, among these, cellulose diacetate is most preferred.

Next will be explained more concretely a method for forming the reverse side layer of the photographic film according to the invention, and so on. The preferred embodiment which will be explained below should not be construed to limit the invention.

In order to locate the first reverse side layer which comprises the compound represented by general formula [I], a tertiary amine and a binder composed of a higher fatty acid and a substantially hydrophobic polymer, the compound of formula [I], a tertiary amine, a higher fatty acid and a hydrophobic polymer may be dissolved in a suitable solvent to make a solution, which may be coated as a coating solution on a support according to a known method and then dried.

The concentration of the compound of formula [I] in the coating solution may suitably range from 0.01 to 1 g. per 100 ml of the solvent, preferably from 0.02 to 0.4 g. per 100 ml of the solvent. While there is no limitation as to the concentration of the tertiary amine, it may suitably range from 0.01 to 2 g. preferably from 0.02 to 0.8 g. per 100 ml of the solvent. The concentration of the higher fatty acid may suitably range from 0.01 to 1 g. per 100 ml of the solvent, preferably from 0.02 to 0.3 g. The concentration of the hydrophobic polymer may suitably range from 0.01 to 2 g. preferably from 0.05 to 0.8 g. per 100 ml of the solvent. The concentration of the solute as a whole may arbitrarily be chosen but it may suitably range from 0.1 to 4 g. preferably from 0.2 to 2 g. per 100 ml of the solution.

With respect to the amounts of the compounds to be coated, the compound of formula [I], the tertiary amine, the higher fatty acid and the hydrophobic polymer may preferably be coated in amounts of 5 to 200 mg/m$^2$, 5 to 500 mg/m$^2$, 5 to 150 mg/m$^2$ and 10 to 500 mg/m$^2$, respectively. While there is no specific limitation as to the solvent for the compound of formula [I] and the hydrophobic polymer, there may be employed acetone, ethyl acetate, methanol, methylene dichloride, ethylene dichloride, trichlene, benzene, phenol, chlorophenol, resorcinol, catechol and so on. Solvent may be used alone or in combination being arbitrarily chosen from the group described above.

In cases where a hydrophobic polymer latex is used, the compound of formula [I] may be dispersed in water and added to a coating solution. As a means for coating said coating solution onto a support may be used a conventional method such as dip-coating, roller-coating and spray-coating, etc. The coated layer may be dried by a conventional method.

In the layer may further be incorporated various additives such as a matting agent which may be necessary depending on the usage of the photographic films.

In cases where an antistatic agent and a tertiary amine are to be used in the second reverse side layer, the compounds are first dissolved or dispersed in a suitable solvent and the formed solution or dispersion may be coated on the above-mentioned first reverse side layer which has been located on a support and then dried. As the solvent for an antistatic agent and a tertiary amine, there may be mentioned, for example, methanol, ethanol, acetone besides water, and they may be employed in combination. The coating solution thus obtained may be coated on the above-mentioned first reverse side layer on a support by a conventional method such as dip-coating, roller-coating and spray-coating and thereafter dried according to a usual method to give the photographic film of the invention.

While there is no specific limitation to the concentration of the antistatic agent in the coating solution, it may advantageously range from 0.01 to 10 g. per 100 ml of the solvent, from the view points of easiness of coating and drying. With respect to the amount of the antistatic agent to be coated for general use, 3 to 300 mg/m$^2$ suffices to impart antistatic property to the film.

The concentration of a tertiary amine to be incorporated in the second reverse side layer may be less than that to be incorporated in the first reverse side layer, and it may suitably range from 0.01 to 1 g. preferably from 0.02 to 0.6 g. per 100 ml of the solvent.

In cases where an inorganic oxide containing an electrolyte, especially alumina sol, is used as an antistatic agent, said alumina sol may preferably be incorporated in the above-mentioned first reverse side layer and the amount of alumina sol to be coated on the first reverse side layer may preferably range from 5 to 500 mg. per square meter of photographic films.

In this case the amounts of a hydrophobic polymer, the compound of formula [I] and a tertiary amine to be coated in the second reverse side layer, may preferably range from 10 to 500 mg., from 5 to 200 mg. and from 5 to 500 mg. per square meter, respectively.

In cases where an inorganic oxide having particle diameter of from 0.01 to 0.5μ is used as an antistatic agent, an inorganic oxide such as silicon oxide, aluminium oxide, magnesium oxide and the like is added into the coating solution for the reverse side layer and adhered directly to the support. The amounts of the hydrophobic polymer, the compound of formula [I], the tertiary amine and the inorganic oxide to be coated may preferably range from 10 to 500 mg., from 5 to 200 mg., from 5 to 500 mg. and from 5 to 800 mg. per square meter, respectively.

As the solvent for the second reverse side layer in which a polyelectrolyte is to be incorporated as an antistatic agent, there may be used the previously mentioned ones to attain the object. However, if the solvent system permeates the first layer excessively, it will impair the transparency after the coating of the second layer due to the remarkably poor compatibility between the polyelectrolyte and the compound of formula [I]. In order to avoid this, more than 5%, preferably from 10 to 30% of water may desirably be contained in the solvent system. When more water is used, the resulting coating solution may be coated together with a coating aid such as surface active agent.

As the support which may be employed for the photographic film of the invention, there may be mentioned a hydrophobic film or sheet such as, for example, cellulose triacetate, polyethylene terephthalate, polycarbonate, polystyrene, polyolefin, a polyethylene-laminated paper and so on. These supports may be under-coated in a known manner as occasion demands.

On the surface of such supports located on the opposite side of another surface on which a layer containing the compound of formula [I] and a tertiary amine has been coated, there may be coated a light-sensitive silver halide emulsion by an ordinary method to afford the photographic film of the invention.

The thus obtained photographic film of the invention not only is excellent in scratch-proof property but also prevents the occurrence of unevenness by streak lines even in the so-called hanger automatic development process. Further, the adherence to a tape is so good that it causes no troubles in the wrapping step of manufacture and the electrification caused by friction or peeling-off may be prevented. Moreover, degradation of photographic characteristics such as reduction of sensitivity, increase of fog and change of gamma value may also be prevented.

The invention will further be explained by the following examples which by no means restrict the scope of the invention.

EXAMPLE 1

On the reverse side of a cellulose triacetate film support coated with a known subbing layer, there was coated Solution A having the composition described below in an amount of 30 ml/m$^2$ and the coating was dried to afford a cellulose triacetate film having the first reverse side layer.

| Solution A | |
|---|---|
| Cellulose triacetate | 4 g. |
| Exemplified compound [I]-(2) | 3 g. |
| Exemplified compound [II]-(3) | 3 g. |
| Acetone | 400 ml. |
| Methylene dichloride | 400 ml. |
| Ethyl acetate | 200 ml. |

Subsequently, Solution B having the composition described below was coated thereon in an amount of 20 ml/m$^2$ and dried to afford an antistatic cellulose triacetate film having both the first and second reverse side layers.

| Solution B | |
|---|---|
| A-copolymer of styrene and sodium p-aminobenzoate salt of maleic acid | 2 g. |
| Methanol | 650 ml. |
| Acetone | 250 ml. |
| Water | 100 ml. |

Further, on the subbing layer located on the opposite side of the support coated with the above-mentioned reverse side layer, there was coated a silver halide emulsion, which was then dried to give a sample of the invention (Sample 1).

EXAMPLE 2

On the reverse side layer of a cellulose triacetate film support coated with a known subbing layer, there was coated Solution C having the composition described below in an amount of 20 ml/m$^2$ and dried to afford a cellulose triacetate film having the first reverse side layer.

| Solution C | |
|---|---|
| Cellulose diacetate | 3 g. |
| Exemplified compound [I]-(4) | 2 g. |
| Stearic acid | 1 g. |
| Silicon dioxide particles (average particle size: 0.2 $\mu$) | 1 g. |
| Acetone | 500 ml. |
| Ethyl acetate | 300 ml. |
| Benzene | 200 ml. |

Subsequently, Solution D having the composition described below was coated thereon in an amount of 20 ml/m$^2$ to give an antistatic cellulose triacetate film having both the first and second reverse side layers.

| Solution D | |
|---|---|
| A copolymer having the following structure: | 1 g. |

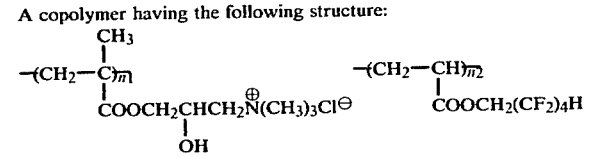

| | |
|---|---|
| wherein $n_1 : n_2 = 50 : 50$. | |
| Exemplified compound [II]-(3) | 0.8 g. |
| Acetone | 400 ml. |
| Methanol | 250 ml. |
| Water | 350 ml. |

Further, on the subbing layer on the opposite side, there was coated a silver halide emulsion to give a sample of invention (Sample 2).

EXAMPLE 3

On the reverse side of a biaxially stretched and crystallized polyethylene terephthalate film support coated with a known subbing layer, there was coated Solution E having the composition described below in an amount of 40 ml/m$^2$ and then dried to give a polyethylene terephthalate film having the first reverse side layer.

| Solution E | |
|---|---|
| Cellulose triacetate | 3 g. |
| A ternary copolymer consisting of vinylidene chloride, methyl acrylate and acrylic acid (65:35:2 by weight) | 1 g. |
| Exemplified compound [I]-(6) | 1.5 g |
| Palmitic acid | 0.6 g. |
| Ethylene dichloride | 650 ml. |
| Methylene dichloride | 200 ml. |
| Phenol | 150 ml. |

Subsequently, Solution F having the composition mentioned below was coated thereon in an amount of 25 ml/m$^2$ and then dried to give an antistatic polyethylene terephthalate film having both the first and second reverse side layers.

| Solution F | |
|---|---|
| A polymer having the structure of the following formula: 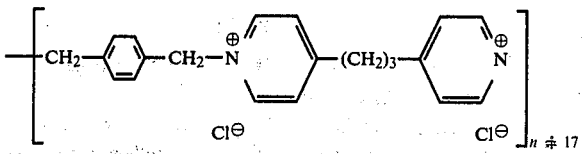 | 5 g. |
| Above-exemplified compound [II]-(10) | 2 g. |
| Resorcinol | 50 g. |
| Saponin | 0.2 g. |
| Acetone | 500 ml. |
| Methanol | 300 ml. |
| Water | 200 ml. |

Further, on the subbing layer on the opposite side was coated a silver halide emulsion and dried to give a sample of the invention (Sample 3).

EXAMPLE 4

On the reverse side layer of a cellulose triacetate film support coated with a known subbing layer, there was coated Solution G having the composition described below in an amount of 20 ml/m$^2$ and then dried to give a cellulose triacetate film having the first reverse side layer.

| Solution G | |
|---|---|
| Alumina sol AS-100 (manufactured by Nissan Chemical Industries, Ltd.) | 40 g. |
| Acetone | 500 ml. |
| Methanol | 300 ml. |
| Methyl isobutyl ketone | 200 ml. |

Subsequently, Solution H having the composition described below was coated thereon in an amount of 15 ml/m$^2$ and then dried to give an antistatic cellulose triacetate film having both the first and second reverse side layers.

| Solution H | |
|---|---|
| Cellulose diacetate | 10 g. |
| Exemplified compound [I]-(8) | 2 g. |
| Exemplified compound [II]-(14) | 3 g. |
| Silicon dioxide particles (average particle size: 0.2 $\mu$) | 1 g. |
| Acetone | 550 ml. |
| Methylene dichloride | 200 ml. |
| Ethylene dichloride | 250 ml. |

Further, on the subbing layer on the opposite side was coated a silver halide emulsion and dried to give a sample of the invention (Sample 4).

EXAMPLE 5

On the reverse side of a cellulose triacetate film support coated with a known subbing layer, there was coated Solution I having the composition described below in an amount of 30 ml/m$^2$ and then dried to give an antistatic triacetate film.

| Solution I | |
|---|---|
| Cellulose diacetate | 8 g. |
| Exemplified compound [I]-(10) | 3 g. |
| Exemplified compound [II]-(18) | 4 g. |
| Aluminium dioxide | 2 g. |
| Acetone | 600 ml. |
| Ethyl acetate | 200 ml. |
| Benzene | 200 ml. |

Further, on the subbing layer on the opposite side was coated a silver halide emulsion and then dried to give a sample of the invention (Sample 5).

EXAMPLE 6

On the reverse side of a cellulose triacetate film support coated with a known subbing layer, there was coated Solution C shown in Example 2 from which stearic acid had been excluded in an amount of 20 ml/m$^2$, and then Solution D shown also in Example 2 in an amount of 20 ml/m$^2$ to give an antistatic cellulose triacetate film having both the first and second reverse side layers. Further, on the subbing layer on the opposite side was coated a silver halide emulsion to give a sample of the invention (Sample 6).

EXAMPLE 7

On the reverse side of a cellulose triacetate film support coated with a known subbing layer, there was coated Solution C shown in Example 2 in an amount of 20 ml/m$^2$ and dried, and then was coated thereon Solution D shown in Example 2 from which above-exemplified compound [II]-(3) had been excluded in an amount of 20 ml/m$^2$ to give an antistatic cellulose triacetate film having both the first and second reverse side layers. Further, on the subbing layer on the opposite side was coated a silver halide emulsion and dried to give a comparative sample (Sample 7).

EXAMPLE 8

On the reverse side of a cellulose triacetate film support coated with a known subbing layer, there was coated Solution C shown in Example 2 from which above exemplified compound [I]-(4) had been excluded in an amount of 20 ml/m$^2$ and then was coated thereon Solution D shown also in Example 2 in an amount of 20 ml/m$^2$ to give an antistatic cellulose triacetate film having both the first and second reverse side layers. Further, on the subbing layer on the opposite side was coated a silver halide emulsion to give a comparative sample (Sample 8).

EXAMPLE 9

On the reverse side of a cellulose triacetate film support coated with a known subbing layer, there was coated Solution G shown in Example 4 in an amount of 20 ml/m$^2$ and then dried, and then was coated thereon Solution H shown also in Example 4 from which above-exemplified compound [I]-(8) had been excluded in an amount of 15 ml/m$^2$ and then dried to give an antistatic cellulose triacetate film having both the first and second reverse side layers. Further, on the subbing layer on the opposite side was coated a silver halide emulsion to give a comparative sample (Sample 9).

EXAMPLE 10

On the reverse side of a cellulose triacetate film coated with a known subbing layer, there were coated Solution G shown in Example 4 in an amount of 20 ml/m$^2$ and then dried, and then was coated thereon Solution H shown also in Example 4 from which above-exemplified compound [II]-(14) had been excluded in an amount of 15 ml/m$^2$ to give an antistatic cellulose triacetate film having both the first and second reverse side layers. Further, on the subbing layer on the opposite side was coated a silver halide emulsion to give a comparative sample (Sample 10).

EXAMPLE 11

On the reverse side of a cellulose triacetate film support coated with a known subbing layer, there was coated Solution A shown in Example 1 from which above-exemplified compound [I]-(4) had been excluded in an amount of 20 ml/m$^2$ and dried, and then was coated thereon Solution B shown also in Example 1 from which above-exemplified compound [II]-(3) had been excluded in an amount of 25 ml/m$^2$ and dried, giving an antistatic cellulose film having both the first and second reverse side layers. Further, on the subbing layer on the opposite side was coated with a silver halide emulsion to give a comparative sample (Sample 11).

EXAMPLE 12

Scratch-proof property of each sample (Samples 1 through 11) was investigated.

Each sample being not processed was set in an ordinary patrone and a high speed photographing was carried out with a still camera to investigate scratch marks generated on the surface thereof.

Next, after each sample was processed according to an ordinary method, printing was conducted by an automatic printer and then scratch marks which appeared on the print were investigated. The results are shown in Table 1.

TABLE 1

| Sample No. | Ranking of scratch-proof property* Before processing | After processing (5th print) |
|---|---|---|
| 1 | 1 | 2 |
| 2 | 1 | 2 |
| 3 | 1 | 2 |
| 4 | 1 | 2 |
| 5 | 1 | 2 |
| 6 | 1 | 2 |
| 7 | 1 | 2 |
| 8 | 4 | 5 |
| 9 | 4 | 5 |
| 10 | 1 | 2 |
| 11 | 5 | 5 |

*Ranking of scratch-proof property (evaluated according to five ranking system)
1: Scratch marks none
2: Scratch marks few
3: Scratch marks a few
4: Scratch marks moderately many
5: Scratch marks many

EXAMPLE 13

Unevenness by streak lines was investigated with respect to each sample.

By using a Nōritsu hanger automatic developing machine, each treatment of color-development, bleaching, fixing and water washing were carried out and finally treatment in which the sample was passed through a stabilizing bath having the following composition was conducted and the thus treated sample was dried.

| Stabilizing bath | |
|---|---|
| 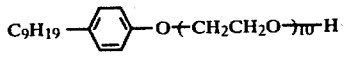 | 2 g. |
| HCHO (37%) | 8 g. |
| Water | to make 1 l. |

Thereafter, the degree of occurrence of unevenness by streak lines was evaluated by observing the samples under a white light. The results are shown in Table 2.

TABLE 2

| Sample No. | Ranking of occurrence of unevenness by streak lines* |
|---|---|
| 1 | 1 |
| 2 | 1 |
| 3 | 1 |
| 4 | 1 |
| 5 | 1 |
| 6 | 1 |
| 7 | 5 |
| 8 | 3 |
| 9 | 3 |
| 10 | 5 |

TABLE 2-continued

| Sample No. | Ranking of occurrence of unevenness by streak lines* |
|---|---|
| 11 | 1 |

*Ranking of occurrence of unevenness by streak lines (evaluated according to 5 ranking system)
1: Occurrence none
2: Occurrence little
3: Occurrence a little (weak)
4: Occurrence moderately much (strong)
5: Occurrence much (strong)

EXAMPLE 14

Adhesiveness of a tape to each sample (Samples 1 through 11) was investigated.

Each sample was set in an ordinary 135 type patrone to obtain a sample contained in a patrone. With respect to these samples, pulling test was conducted under the following conditions.

[1] Atmosphere: 23° C., 50% RH

[2] Pulling speed: 10 cm/min.

The results are shown in Table 3.

TABLE 3

| Sample No. | Pulling strength at break (Kg) |
|---|---|
| 1 | 8.2 |
| 2 | 8.5 |
| 3 | 9.0 |
| 4 | 9.6 |
| 5 | 8.7 |
| 6 | 7.5 |
| 7 | 4.0 |
| 8 | 5.7 |
| 9 | 6.1 |
| 10 | 3.8 |
| 11 | 4.2 |

As is clear from Tables 1 to 3, it can be seen that the samples (Samples 1 through 6) according to the invention are excellent in scratch-proof property and adhesiveness of a tape thereto, and unevenness by streak lines does not occur after processing.

In contrast with that, comparative samples (Samples 7 through 11) which do not have at least one of the compound represented by general formula [I] and a tertiary amine, have at least one defect with respect to the scratch-proof property, adhesiveness of a tape thereto and occurrence of unevenness by streak lines.

We claim:

1. A photographic film having at least one light-sensitive silver halide emulsion layer on one side of a support and at least one reverse side layer on the other side of the support which comprises, in said reverse side layer, a compound represented by formula [I]:

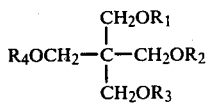

[I]

wherein $R_1$, $R_2$, $R_3$ and $R_4$ each represent a hydrogen atom or an aliphatic acyl group having from 12 to 24 carbon atoms provided that at least three of $R_1$, $R_2$, $R_3$ and $R_4$ each represent an aliphatic acyl group having from 12 to 24 carbon atoms, and a tertiary amine represented by the formula [II]:

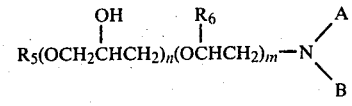

[II]

wherein $R_5$ represents an alkyl group having from 8 to 24 carbon atoms; $R_6$ represents a hydrogen atom, a methyl group or a group $—CH_2OR_7$ in which $R_7$ means a hydrogen atom, an alkyl group having from 1 to 7 carbon atoms, an aryl group or an aralkyl group; m and n each represent an integer of from 0 to 3 (provided $3 \geqq m+n \geqq 1$); A represents a group

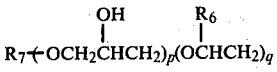

in which $R_6$ and $R_7$ have the same meanings as defined above, and p and q each represent an integer of from 1 to 3 (provided $3 \geqq p+q \geqq 1$); and B represents an alkyl group having from 1 to 7 carbon atoms, an aryl group, an aralkyl group or a group

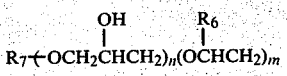

in which $R_6$, $R_7$, m and n have the same meanings as defined above.

2. A photographic film according to claim 1 wherein said reverse side layer is composed of not less than two layers.

3. A photographic film according to claim 1 wherein said at least one reverse side layer contains an antistatic agent.

4. A photographic film according to claim 1 wherein said at least one layer contains a hydrophobic polymer.

5. A photographic film according to claim 2 wherein said reverse side layer is composed of at least one layer [i] containing the compound of formula [I] and a hydrophobic polymer and at least one layer [ii] containing a tertiary amine and an antistatic agent, said layer [i] being located closer to the support than said layer [ii].

6. A photographic film according to claim 2 wherein said reverse side layer is composed of at least one layer [i] containing the compound of formula [I], a tertiary amine and a hydrophobic polymer and at least one layer [ii] comprising an antistatic agent.

7. A photographic film according to claim 1 wherein said reverse side layer is composed of at least one layer comprising the compound of formula [I], a tertiary amine, a hydrophobic polymer and an antistatic agent in the same layer.

8. A photographic film according to claim 5 wherein said layer [i] comprises the compound of formula [I], a hydrophobic polymer and a higher fatty acid.

9. A photographic film according to any one of claims 4 to 8 wherein said hydrophobic polymer is a cellulose derivative.

10. A photographic film according to claim 9 wherein said cellulose derivative is cellulose diacetate.

11. A photographic film according to claim 3, 5 or 6 wherein said antistatic agent is a polyelectrolyte.

12. A photographic film according to claim 3 or 6 wherein said antistatic agent is an inorganic oxide containing an electrolyte.

13. A photographic film according to claim 12 wherein said inorganic oxide is alumina sol.

14. A photographic film according to claim 3 or 7 wherein said antistatic agent is an inorganic oxide having a grain diameter of 0.01 to 0.5$\mu$.

15. A photographic film according to claim 5 or 6 wherein said layer [ii] was coated by using a coating solvent which does not dissolve said layer [i].

16. A photographic film according to claim 15 wherein said coating solvent is water.

* * * * *